US006110087A

United States Patent [19]

Dice

[11] Patent Number: 6,110,087

[45] Date of Patent: Aug. 29, 2000

[54] KNOCKDOWN TRANSFER APPARATUS AND METHOD

[75] Inventor: Todd Andrew Dice, Rancho Cucamonga, Calif.

[73] Assignee: S.V. Dice Designers, Walnut, Calif.

[21] Appl. No.: 09/085,706

[22] Filed: May 27, 1998

[51] Int. Cl.[7] ..... B31B 1/36

[52] U.S. Cl. ..... 493/131; 493/132

[58] Field of Search ..... 493/55, 123, 125, 493/126, 131, 167

[56] References Cited

U.S. PATENT DOCUMENTS

| | | | |
|---|---|---|---|
| 3,611,886 | 10/1971 | Scully | 493/132 |
| 3,626,820 | 12/1971 | Scully | 493/269 |
| 3,656,417 | 4/1972 | Scully | 493/131 |
| 4,215,522 | 8/1980 | Clift et al. | 53/378 |
| 4,604,083 | 8/1986 | Barny et al. | 493/34 |
| 5,087,023 | 2/1992 | Gilbert et al. | 270/39 |
| 5,123,890 | 6/1992 | Green, Jr. | 493/357 |
| 5,163,891 | 11/1992 | Goldsborough et al. | 493/321 |
| 5,393,291 | 2/1995 | Wingerter | 493/116 |
| 5,454,776 | 10/1995 | Ulrich et al. | 493/117 |
| 5,758,438 | 6/1998 | Crowell | 40/124.08 |

*Primary Examiner*—Joseph J. Hail, III
*Assistant Examiner*—Dermott J. Cooke
*Attorney, Agent, or Firm*—Lyon & Lyon LLP

[57] ABSTRACT

An apparatus and method for printing onto and erecting a box. A feeder holds knockdowns, which are transported to a printer in a substantially vertical position and printed upon. An upper knockdown kickout guide and a lower knockdown kickout move the knockdown into a diagonal position and impel it forward such that the knockdown is momentarily airborne. A roller or rollers facilitate the entry of the printed knockdown into a hopper by minimizing horizontal friction encountered by the printed knockdown. The printed knockdowns are transported from the hopper to an erector, where they are erected into completed boxes.

14 Claims, 5 Drawing Sheets

KNOCKDOWN TRANSFER APPARATUS AND METHOD

FIELD OF THE INVENTION

This invention generally relates to packaging machinery, and more particularly to an apparatus and method for printing onto and erecting a box.

BACKGROUND OF THE INVENTION

In the packaging machinery industry, a type of machine commonly referred to as a printing machine exists. A printing machine places words or symbols onto a box before it has been erected; that is, while the box is still a knockdown. A knockdown, also referred to in the industry as a flat or a KD, is simply a relatively flat piece of material precut and scored such that it can easily be formed into a box. Typically, knockdowns are placed in bulk into a feeder in a printing machine. Those knockdowns are then transported one at a time to a printer, where the machine directly prints onto the knockdown or places a label, preprinted or printed elsewhere in the machine, onto the knockdown. The knockdowns are then routed into a hopper, where they collect and are periodically removed by a worker.

Printing machines are used for several reasons. A printing machine enables the user to print custom or specific information on a box, such as UPC symbols, descriptions of the contents of the box, or other information. This is especially useful in industries where a range of different products are produced or packaged in one location into boxes of similar size. Printing custom or specific information onto a blank knockdown, or onto a standard knockdown pre-printed with general information, saves inventory costs by reducing the number of different types of knockdowns that must be stored.

A different type of packaging machine commonly referred to as an erecting machine also exists. An erecting machine repetitively erects knockdowns into boxes significantly faster than a person could.

Some users of packaging machinery need to print onto a knockdown and erect it into a box. Currently, to do so that user must purchase and operate both a printing machine and an erecting machine. Using two separate machines for printing and erecting is undesirable for several reasons. First, separate machines place a burden on the facility containing them. Separate machines occupy significant floor space. Separate machines also require separate power feeds, which can restrict the placement of the machines in a packaging facility, or necessitate expensive rewiring of the facility to enable the machines to occupy the most efficient locations relative to one another. Second, separate erecting and printing machines use labor inefficiently. After the hopper in a printing machine fills with printed knockdowns, an operator must stop the printing machine, remove the printed knockdowns from the hopper, and place them into a feeder on the erecting machine. Manually transferring boxes between the machines is time consuming, and substantially limits the speed at which printed or labeled boxes can be erected. Further, manual transfer of knockdowns between machines can be dangerous, as the person moving the knockdowns may need to move them across a busy industrial floor containing heavy machinery, other workers, forklifts, and other potential sources of collision or accident. In addition, manually moving knockdowns from a printing machine to an erecting machine is tedious and dull. Third, the operator can easily place printed knockdowns into an erector backwards, which can jam the machine or lead to boxes sealed at the top and open at the bottom. Both outcomes result in lost production time and wasted material.

SUMMARY OF THE INVENTION

The present invention is directed toward an apparatus and method for printing and erecting boxes, such as corrugated paper packing boxes.

In a first aspect of the invention, a case printer-erector combines the actions of printing onto a box knockdown and erecting that knockdown into a single machine.

In a second aspect of the invention, an upper knockdown kickout guide pushes the top edge of a vertically-oriented knockdown forward. The upper knockdown kickout guide is shaped such that its motion contributes to impelling the knockdown forward in a horizontal orientation.

In a third aspect of the invention, a lower knockdown kickout acts in cooperation with the upper knockdown kickout guide. The lower knockdown kickout pushes the bottom edge of a vertically-oriented knockdown outward faster and further than the upper knockdown kickout guide, thereby contributing to the short, relatively horizontal airborne motion of the knockdown to a hopper.

In a fourth aspect of the invention, one or more rollers are mounted adjacent to the edge of the hopper. A knockdown traveling into the hopper encounters the roller or rollers as it moves down and horizontally. The roller or rollers facilitate the travel of a knockdown into the hopper by substantially halting its downward travel and by reducing friction in a horizontal direction, enabling the knockdown to move horizontally into the hopper with minimal frictional resistance.

DETAILED DESCRIPTION OF THE PREFERRED EMBODIMENTS

Figure 1:
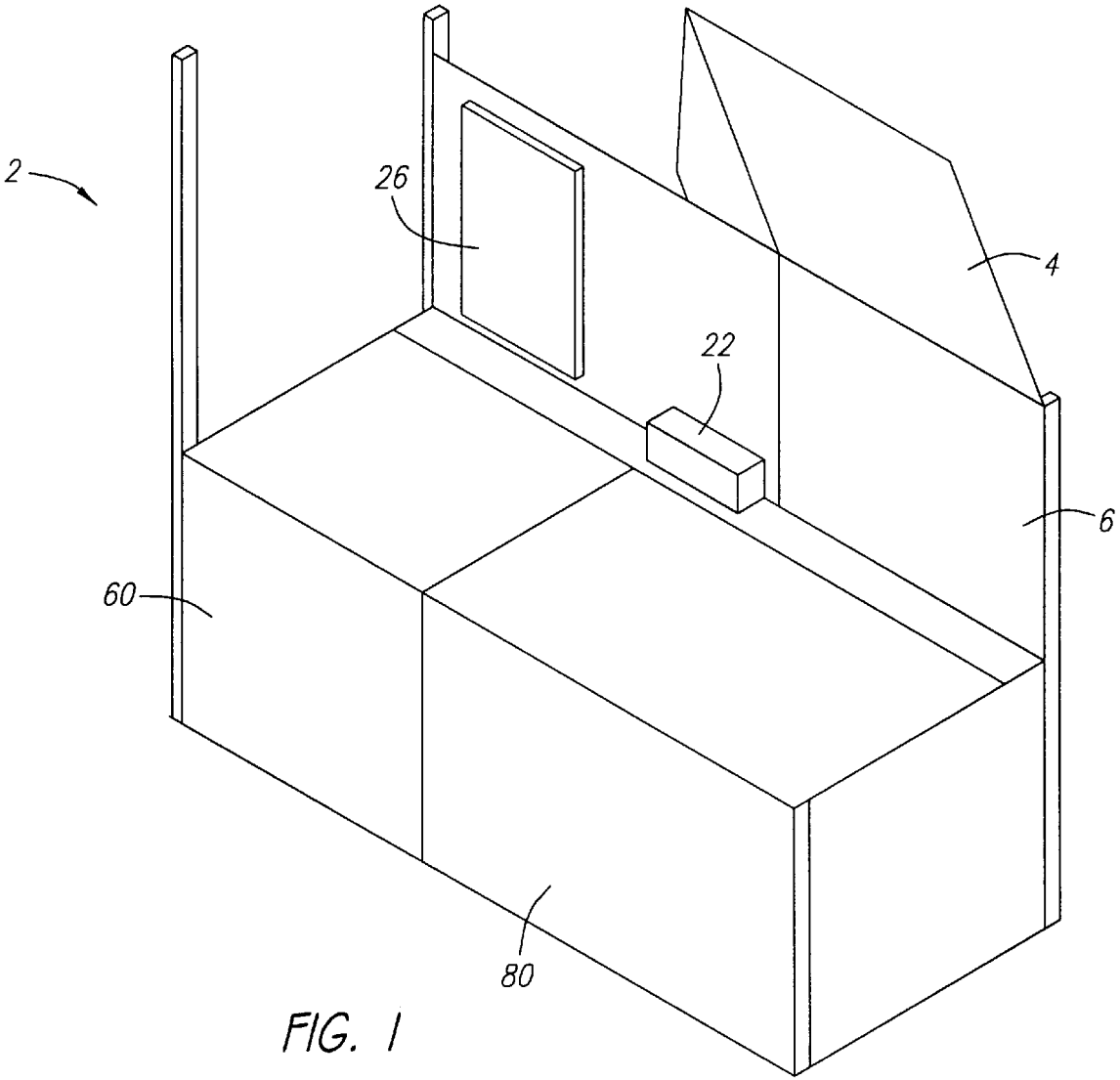
FIG. 1 is a schematic overview of the major components of a case printer-erector.

Referring to FIG. 1, an overview of the major components of a case printer-erector 2 is presented. A feeder 4 feeds knockdowns 6 to a printer 22, which prints upon them. A transfer mechanism 26 then transfers the knockdowns 6 to a hopper 60. The knockdowns 6 are then transported to an erector 80, where they are erected into boxes.

Figure 2:
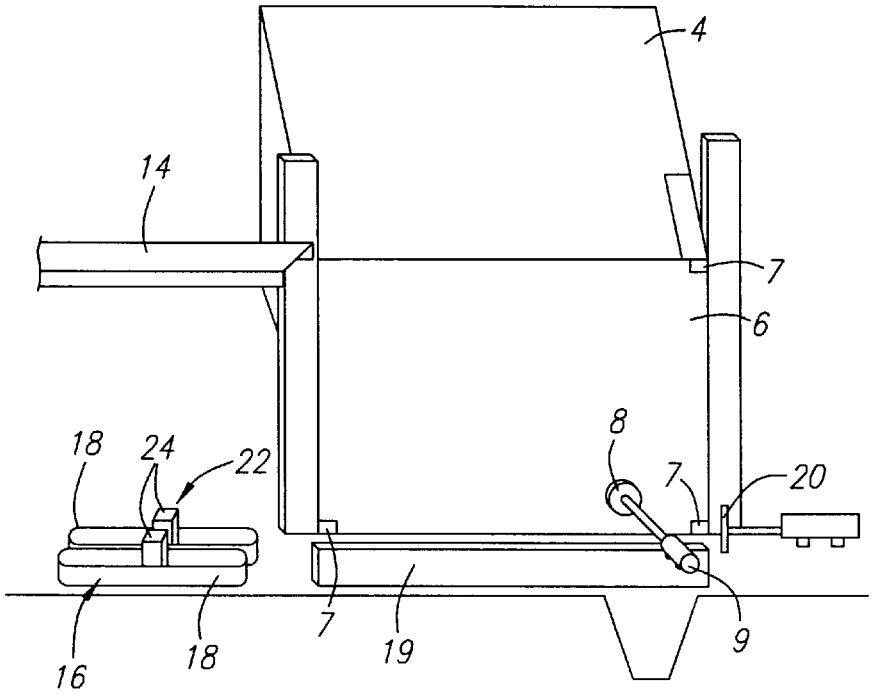
FIG. 2 is a view of a portion of the case printer-erector directed toward a feeder and a printer.

Referring to FIG. 2, the feeder 4 holds one or more of what are referred to in the art as knockdowns 6. A knockdown 6 is a relatively flat piece of material that is precut and scored such that it can easily be manipulated to form a box. While a knockdown 6 is typically made of corrugated paper, the case printer-erector 2 can accept knockdowns 6 composed of other materials or combinations of materials.

Preferably, the feeder 4 is oriented such that the knockdowns 6 within it stand vertically and in parallel with one another. FIG. 2 only shows the frontmost knockdown 6 in the feeder 4. However, the feeder 4 may be configured to hold to knockdowns 6 in orientations other than vertical. The bottom of the feeder 4 is preferably sloped downward from back to front. This downward slope allows the knockdowns 6 to slide from back to front inside the feeder 4 due to gravitational force, without the need for a mechanism to impel the knockdowns 6 forward. The back-to-front motion of the knockdowns 6 within the feeder 4 allows an operator to place additional blank knockdowns 6 into the rear of the feeder 4 as required without interrupting its operation. The feeder 4 may be configured to hold knockdowns 6 of varying size, allowing the case printer-erector 2 to print and erect boxes of varying size.

The knockdowns 6 are preferably restrained inside the feeder 4 by tabs 7 located at the front of the feeder 4. Preferably, these tabs 7 are blocks located at the corners of the front of the feeder 4. Viewing the feeder 4 from the front, these tabs 7 extend approximately 0.25 inches vertically and laterally, and prevent the forward motion of the frontmost knockdown 6 in the feeder 4 by restraining its corners from forward motion.

Figure 3:
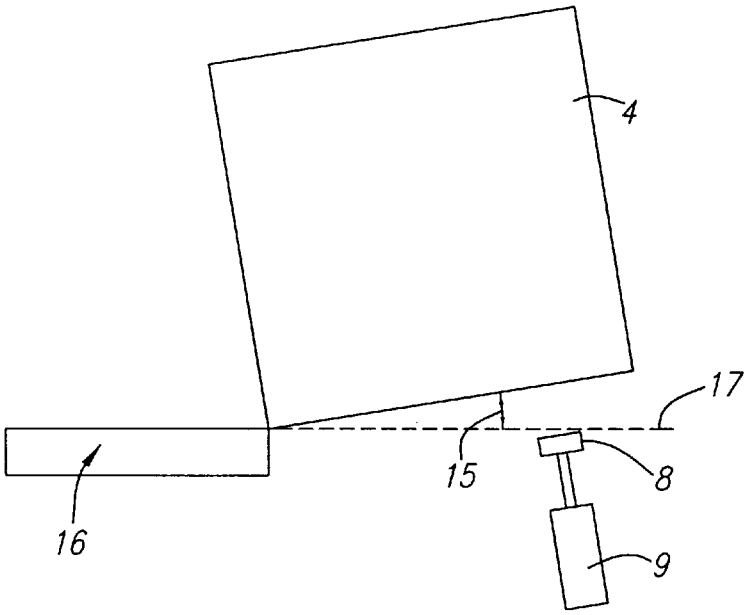
FIG. 3 is a top view of the relationship between a feeder and other components of a case printer-erector.

Another component of the case printer-erector 2 is a first transport mechanism 16, which transports knockdowns 6 from the feeder to the printer 22. Referring to FIG. 3, the front face of the feeder 4 is preferably oriented at an angle 15 of 10 degrees or less to a line 17 defined by the direction of travel of the knockdown 6 through the first transport mechanism 16, such that the left edge of the front face of the feeder 4 is located in close proximity to the first transport mechanism 16 and the right edge of the front face of the feeder 4 is located further away from the line 17 than is the left edge of the front face of the feeder 4.

Referring back to FIG. 2, the knockdowns 6 are pulled one at a time from the front of the feeder 4, preferably by a vacuum cup 8 mounted on an actuator 9. However, any other mechanism may be used that can reliably and repetitively pull knockdowns 6 from the feeder 4. The vacuum cup 8 and actuator 9 are positioned such that the actuator 9 reciprocates perpendicular to the front face of the frontmost knockdown 6 in the feeder 4, and preferably positioned such that the vacuum cup 8 contacts the knockdown 6 at a location between its vertical centerline and right edge. The actuator 9 extends after a time interval. When the vacuum cup 8 comes into contact with the knockdown 6, vacuum is applied to the vacuum cup 8 and the actuator 9 retracts. The vacuum cup 8 thereby pulls the knockdown 6 forward, causing it to flex slightly as the tabs 7 restrain it. As the actuator 9 continues to retract, the knockdown 6 flexes sufficiently to leave the feeder 4 over the tabs 7. By pulling the knockdown 6 out of the angled feeder 4 on the right side of the knockdown 6, its left edge as viewed from the front of the feeder 4 remains close to the first transport mechanism 16 and the right edge of the knockdown 6 is brought substantially parallel with a front stop 19. The front stop 19 is substantially parallel to the line 17 shown in FIG. 3. In addition, as the knockdown 6 is pulled out of the feeder 4, its upper edge is pulled into a top channel 14. Preferably, the top channel 14 has a substantially U-shaped cross section. The top channel 14 holds the knockdown 6 in a vertical position by restraining the motion of its top edge.

After being pulled from the feeder 4, the knockdown 6 is moved into a first transport mechanism 16, preferably by a paddle 20 that pushes the knockdown 6 into the first transport mechanism 16. The first transport mechanism 16 preferably consists of two belts 18, where one is driven in a clockwise motion and the other is driven in a counterclockwise motion, and their location relative to one another is close enough that they exert pressure on a knockdown 6 placed between them, thereby trapping the knockdown 6 between the belts 18 and causing it to move with the belts 18. Advantageously, the belts 18 are separated by a distance slightly less than the thickness of a knockdown 6. However, any first transport mechanism 16 may be used that can move a knockdown 6.

The belts 18 pull the knockdown 6 through a printer 22. Preferably, the printer 22 consists of two noncontact print heads 24, mounted such that the noncontact print heads 24 can print desired content onto a knockdown 6 as the first transport mechanism 16 translates the knockdown 6 past the noncontact print heads 24. Alternately, the printer 22 may be a device for applying a label to the knockdown 6, whether that label is preprinted or is printed immediately before application to the knockdown 6. Additionally, any other printing mechanisms which can print or place desired information onto a knockdown 6 may be used.

After the printer 22 has printed onto the knockdown 6, the first transport mechanism 16 continues to transport the knockdown 6 past and away from the printer. After being carried through the first transport mechanism 16, the knockdown 6 comes to a stop in the transfer mechanism 26. Preferably, the first transport mechanism 16 is operated at such speed that the knockdown 6 comes to a stop due to the effect of friction with the structure of the case printer-erector 2 shortly after its exit from the first transport mechanism 16.

Figure 4:
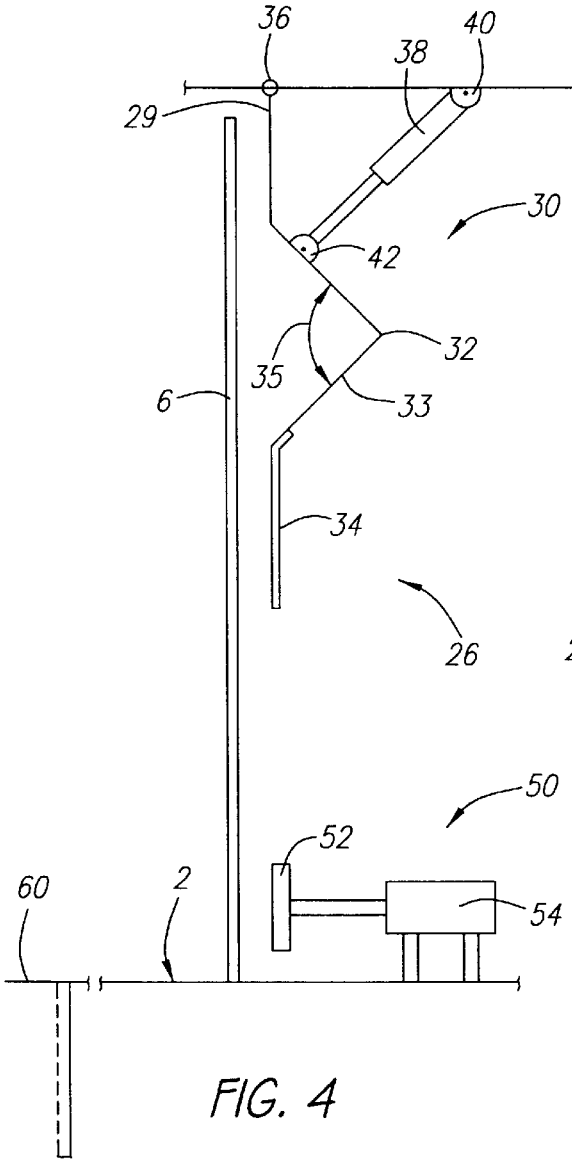
FIG. 4 is a side view of a transfer mechanism.

The transfer mechanism 26 acts to transfer the knockdown 6 into the hopper 60. Referring to FIG. 4, the transfer mechanism 26 is composed of two cooperating mechanisms: an upper knockdown kickout guide 30 and a lower knockdown kickout 50.

Figure 5:
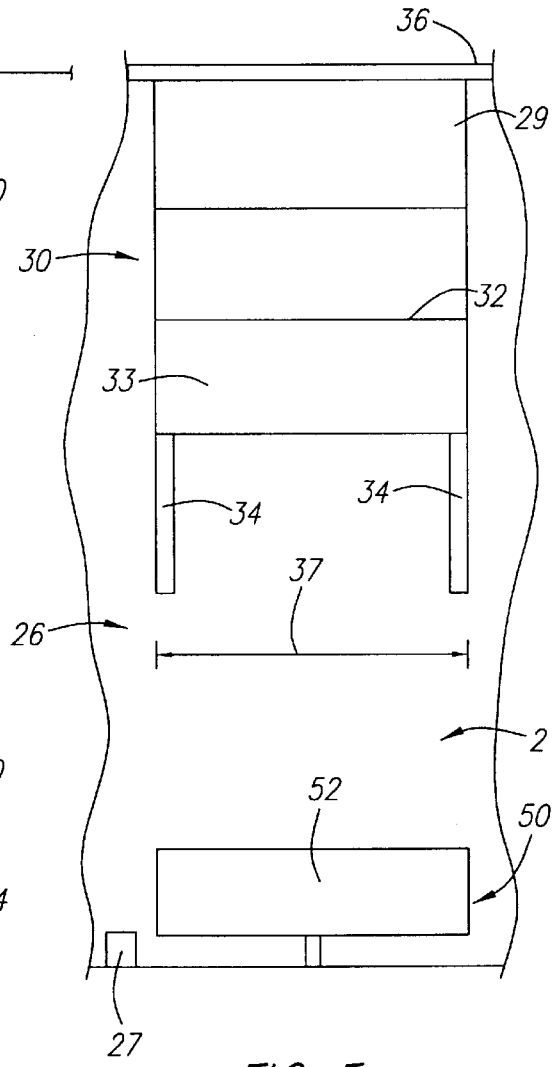
FIG. 5 is a front cutaway view of a transfer mechanism.

An angle member 32 forms the main portion of the structure of the upper knockdown kickout guide 30. Referring to FIG. 5, the angle member 32 preferably possesses a length 37 of at least 12 inches. While the angle member 32 may be shorter than 12 inches, a length of 1 inch or shorter is undesirable, as an angle member that narrow would act as a pivot point when pushing a knockdown 6. The structure of the angle member 32 defines an angle 35.

Preferably, the angle member 32 is suspended from a rod 36, around which the angle member 32 can swivel. However, hinges or any other mechanism providing for a swiveling motion toward and away from the hopper 60 by the angle member 32 may be used. Two or more fingers 34 extend from the bottom edge of the angle member 32. Preferably, these fingers are 1 inch wide, but wider fingers may be substituted if desired. Preferably, the fingers 34 extend at least halfway down the vertical dimension of the knockdown 6. The fingers 34 are positioned substantially parallel with an upper portion 29 of the angle member 32. An actuator 38 causes the angle member 32 to swivel around the rod 36. The actuator 38 is attached on one end to a first swivel joint 40 mounted on a part of the case printer-erector 2 that remains stationary relative to the upper knockdown kickout guide 30, and on the other end to a second swivel joint 42 mounted on the upper knockdown kickout guide 30. Preferably, the actuator 38 is an air cylinder, but any actuator capable of repetitive linear motion may be used.

The rod 36 may be moved up or down to enable the upper knockdown kickout guide 30 to function with multiple sizes of knockdowns 6.

A lower knockdown kickout 50 cooperates with the upper knockdown kickout guide 30 to move the knockdown 6 into the hopper 60. The lower knockdown kickout 50 includes a kicker 52. Preferably, the kicker 52 is a thin bar oriented such that its longest dimension is parallel to the knockdown 6. The kicker 52 is attached to a driver 54, which pushes the kicker 52 outward in coordination with the upper knockdown kickout guide 30. Preferably, the driver 54 is an air cylinder.

When a knockdown 6 arrives at the transfer mechanism 26, its presence is detected by a sensor 27, shown in FIG. 5, preferably a photodetector. The actuator 38 then begins to extend, causing the angle member 32 to swivel about the rod 36 toward the hopper 60. At approximately the same time as the actuator 38 begins to extend, the driver 54 also begins to extend, thereby pushing the kicker 52 outward. These events need not happen simultaneously; however, they must occur close enough to one another to impel the knockdown 6 as described below.

The driver 54 extends further and faster than the actuator 38. The bottom of the knockdown 6 thereby moves further and faster than the top of the knockdown 6. This differential motion causes the top of the knockdown 6 to move downward as well as outward. Consequently, the top edge of the knockdown 6 slides along the upper portion 29 of the upper knockdown kickout guide 30 until it reaches the angle member 32, at which point it falls into the angle member 32 and is caught by the bottom portion 33 of the angle member 32. To enable the bottom portion 33 of the angle member 32 to catch the top edge of the knockdown 6, the angle 35 of the angle member 32 is preferably a right angle. However, the angle member 32 may describe any angle 35 that is large enough to allow the top edge of the knockdown 6 to slide against the upper portion 29 and subsequently fall onto the bottom portion 33 of the angle member 32.

After the angle member 32 catches the top edge of the knockdown 6, the actuator 38 and the driver 54 each continue to extend, eventually causing the bottom edge of the knockdown 6 to rise into the air. When this happens, the fingers 34, if they have not already, begin to assist in supporting and stabilizing the knockdown 6. At the same time, the bottom edge of the knockdown 6 continues to slide away from the lower knockdown kickout 50. As the upper knockdown kickout guide 30 continues to swivel toward the hopper 60, the knockdown 6 slides down the fingers 34 as the fingers 34 push the knockdown 6 upward and outward toward the hopper 60. As a result, the knockdown 6 becomes airborne, and moves in a substantially diagonal manner toward the hopper 60.

Figure 6:
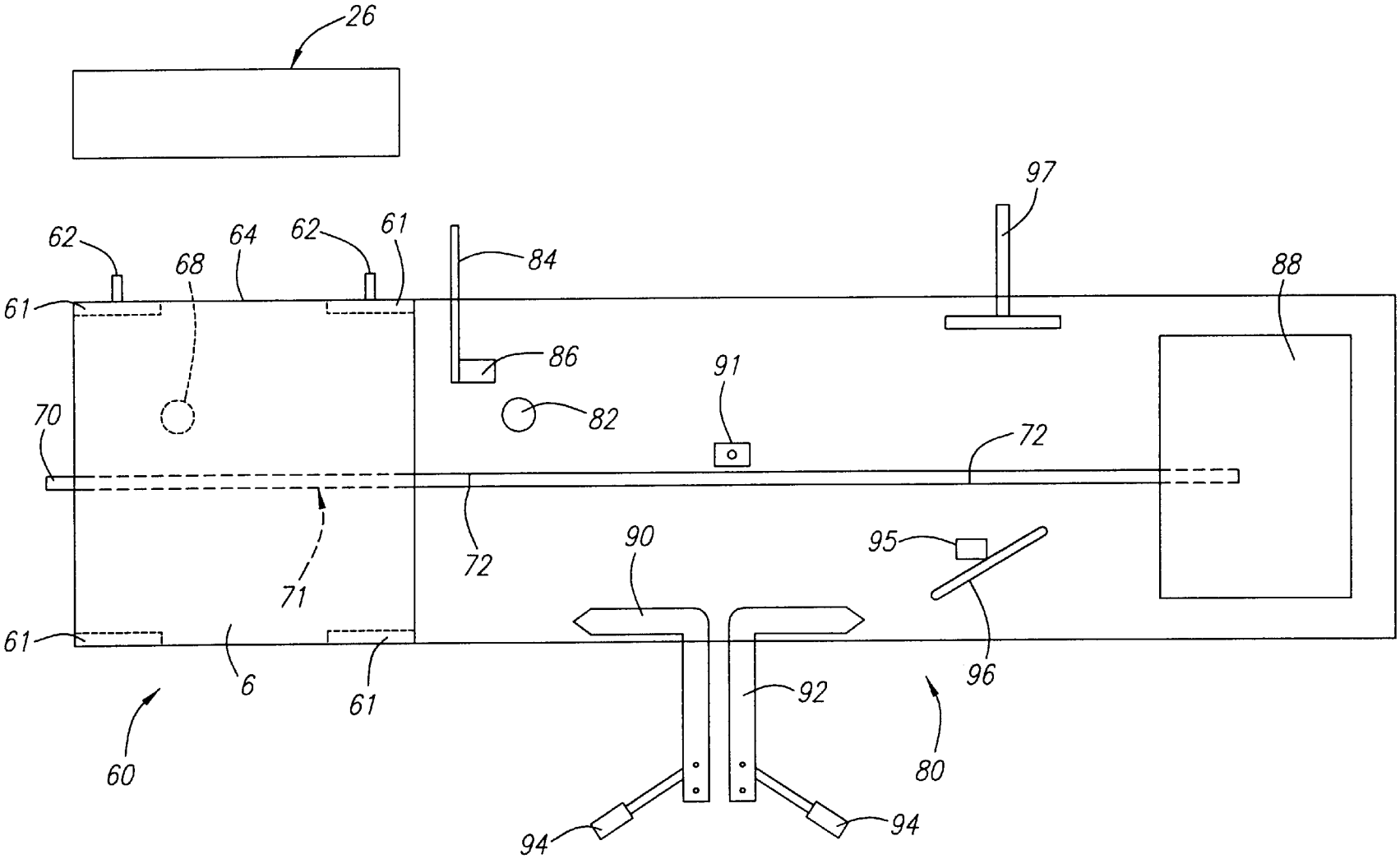
FIG. 6 is a top view of a portion of the case printer-erector directed toward a hopper and an erector.

Referring to FIG. 1, the hopper 60 is located at a lower position than the transfer mechanism 26, such that the knockdown 6 easily travels through the air from the transfer mechanism 26 diagonally into the hopper 60. FIG. 6 shows a top view of the hopper 60 and the erector 80.

Figure 7:
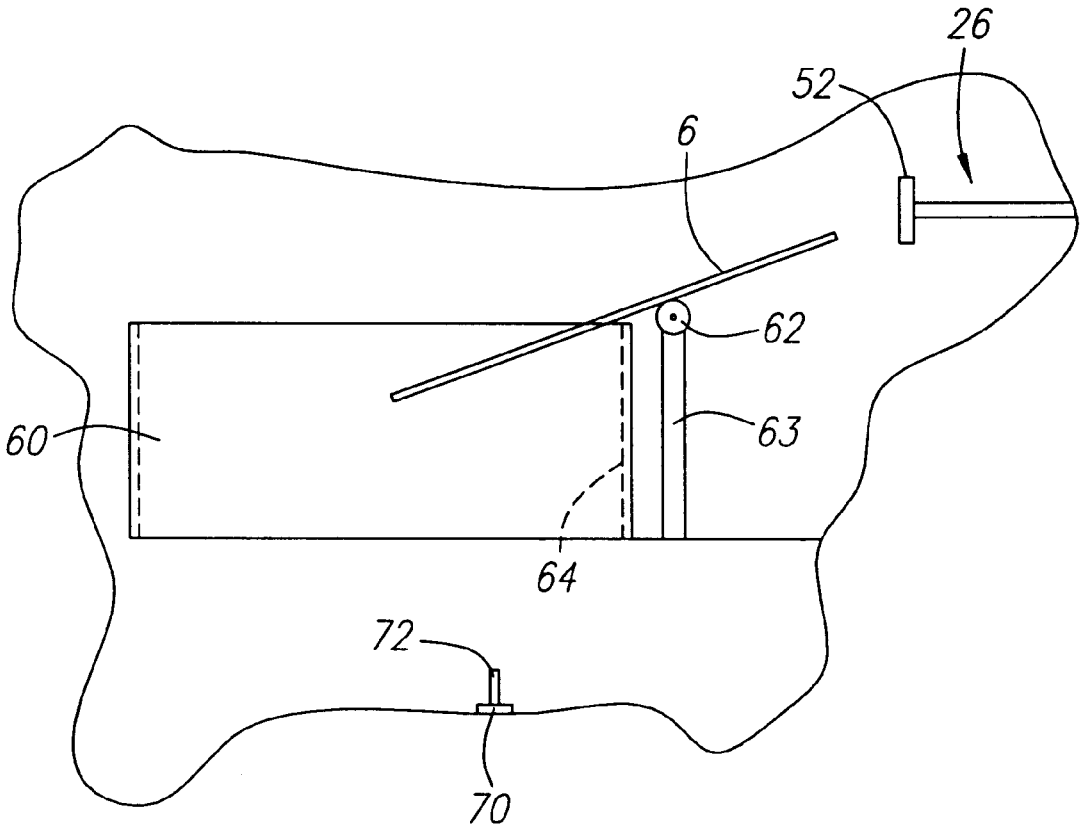
FIG. 7 is a side cutaway view of a portion of the case printer-erector directed toward a hopper.

Referring to FIG. 7, one or more rollers 62 assist the knockdown 6 in entering the hopper 60. As the knockdown 6 travels into the hopper, it comes into contact with the roller or rollers 62. The roller or rollers 62 are mounted in close proximity to the retaining plate 64, such that the top of each roller 62 extends above the top of the retaining plate 64. The roller or rollers 62 are mounted such that the direction of rotation of the roller or rollers 62 is substantially perpendicular to the retaining plate 64 and substantially parallel to the direction of travel of the knockdown 6 from the transfer mechanism 26 to the hopper 60. Preferably, two rollers 62 are used, one at each end of the retaining plate 64. However, more than two rollers 62 may be used if desired. The rollers may be mounted on support pieces 63, or mounted directly to the retaining plate 64. Alternately, one roller may be used, mounted at any location along the retaining plate 64. The roller or rollers 62 help the knockdown 6 to travel over the retaining plate 64 and prevent the knockdown 6 from coming into substantial contact with the upper edge of the retaining plate 64. As the knockdown 6 encounters the roller or rollers 62, the roller or rollers 62 begin to rotate. Due to the minimal rolling friction of the roller or rollers 62, the diagonal motion of the knockdown 6 into the hopper 60 is substantially unimpeded. Without the roller or rollers 62, friction between the knockdown 6 and the top edge of the retaining plate 64 can cause the knockdown 6 to come to an undesired halt before entering the hopper 60.

Referring back to FIG. 6, the knockdown 6 then settles into the hopper 60. The relatively close fit between the edges of the knockdown 6 and the walls of the hopper 60 trap ambient air underneath the knockdown 6, cushioning its fall into the hopper 60 and enabling it to come to rest in the hopper 60 with a minimal chance of damage. The hopper 60 may be adjusted to accommodate varying sizes of knockdowns 6.

Advantageously, the knockdowns 6 accumulate in the hopper 60, which can hold a plurality of knockdowns 6 in a horizontal position. However, the hopper 60 can simply be a guide that accepts knockdowns 6 from the transfer mechanism 26 one at a time, without the capacity for allowing knockdowns 6 to accumulate within.

Preferably, the knockdowns 6 are supported from the bottom of the hopper 60 by four tabs 61 at the bottom corners of the hopper 60. Preferably, the tabs 61 are 0.375 inches wide and six inches long, but other dimensions may be used so long as the tabs 61 can adequately support the knockdowns 6 within the hopper 60 and allow removal of knockdowns 6 from the bottom of the hopper 60.

The knockdowns 6 are fed one at a time from the hopper 60 to the erector 80 by a second transport mechanism 71. Preferably, the second transport mechanism includes a second vacuum cup 68, a chain 70, and at least one flight lug 72. The second vacuum cup 68 pulls one knockdown 6 at a time from the bottom of the stack in the hopper 60. As the knockdown 6 is pulled downward by the second vacuum cup 68, it flexes slightly and thereby escapes from the vertical restraint previously imposed by the tabs 61. The second vacuum cup 68 pulls the knockdown 6 onto the chain 70, then releases the vacuum within, freeing the knockdown 6. The chain 70 moves at a substantially constant speed, and runs underneath and substantially parallel to the bottom of the hopper 60 between the hopper 60 and the erector 80 in the direction of the erector 80. Attached to the chain 70 is at least one flight lug 72. As the flight lug 72 moves along the path of the chain 70, it encounters the knockdown 6 resting on the chain 70 and pushes the knockdown 6 into the erector 80. While the preferred second transport mechanism 71 has been disclosed, any second transport mechanism 71 may be used that can deliver knockdowns 6 from the hopper 60 to the erector 80 reliably and repetitively.

Erectors 80 are known in the art. For example, a case erector is disclosed in U.S. Pat. No. 4,498,893, the contents of which are herein incorporated by reference. In the preferred embodiment, a knockdown 6 is transported into the erector 80. The knockdown 6 then comes to a stop as it contacts one or more case stop dogs 91. A third vacuum cup 82, positioned beneath the knockdown 6, moves upward to contact the knockdown 6. Vacuum is applied to the third vacuum cup 82, holding the knockdown 6 in position. An articulated arm 84, on the tip of which is a fourth vacuum cup 86, moves such that the fourth vacuum cup 86 contacts the top portion of the knockdown 6. Vacuum is applied to the fourth vacuum cup 86, thereby creating suction against the top portion of the knockdown 6. The articulated arm 84 then moves upward and backward, thereby opening the knockdown 6 into a box 88.

A first pusher arm 90 and a second pusher arm 92, impelled by air cylinders 94, then swivel inward toward the box 88. The first pusher arm 90 and the second pusher arm 92 are curved into an approximate "L" shape such that as they swivel inward, they contact the inner bottom flaps, also known as minor flaps, of the box 88 and smoothly push those minor flaps closed.

The vacuum is then released from the third vacuum cup 82 and the fourth vacuum cup 86, freeing the box 88. The flight lug 72 attached to the chain 70 then pushes the box 88 past the glue applicator 95 and major flap folders 96 to the presser foot 97. The glue applicator 95 sprays glue onto the minor flaps of the box 88. After glue is applied, the box 88 encounters a pair of major flap folders 96 that smoothly plow the outer bottom flaps of the box 88 until they contact the glue applied to the minor flaps. The outer bottom flaps of box 88 are more commonly known as major flaps. The presser foot 97 presses the minor flaps against the major flaps thus squeezing the glue and sealing the flaps, creating a complete box 88 that is ready for use. A new box that is entering the presser foot 97 station that is being driven by the flight lug 72 displaces the completed box 88 away from the presser foot 97, where an operator can remove it from the case printer-erector 2. While the preferred embodiment has been disclosed, any mechanism or combination of mechanisms that can reliably and repetitively erect completed boxes from knockdowns 6 may be used as an erector 80.

A preferred apparatus and method for printing and erecting a box and many of its attendant advantages have thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

What is claimed is:

1. An apparatus for moving a knockdown oriented in a vertical position to a horizontal position, comprising:

a transfer mechanism having an upper knockdown kickout guide with an actuator and a lower knockdown kickout guide having a kicker, wherein said upper knockdown kickout guide being pivotally supported and having an angle member including an upper portion and a bottom portion, said bottom portion defining an angle with an adjacent structure of the angle member and said upper portion aligned parallel to the vertically-oriented knockdown, and a plurality of fingers extending from a bottom edge of said angle member for contacting the surface of the knockdown, further wherein said actuator having a distal end attached to said upper knockdown kickout guide for causing pivoting of said upper knockdown kickout guide, still further wherein said lower knockdown kickout guide located below said upper knockdown kickout guide and having a driver with a distal end for causing reciprocation of said kicker connected to said distal end of said driver, and a hopper for receiving knockdowns from said transfer mechanism, said hopper being located adjacent to and at a lower level than said transfer mechanism, said hopper having one or more rollers adjacent to said transfer mechanism with horizontal axes oriented parallel to a wall of said hopper adjacent to said transfer mechanism such that a top of said one or more rollers extends above said wall of said hopper.

2. The apparatus of claim 1, wherein said upper knockdown kickout guide is attached to a rod, said rod being pivotally supported by the case printer-erector.

3. The apparatus of claim 1, wherein said bottom portion of said angle member defines a right angle with said adjacent structure of said angle member.

4. The apparatus of claim 1, wherein said angle member is at least 12 inches in length.

5. The apparatus of claim 1, wherein said driver includes an air cylinder.

6. The apparatus of claim 1, wherein said hopper is capable of holding a plurality of knockdowns.

7. The apparatus of claim 1, wherein said hopper has two of said rollers.

8. The apparatus of claim 1, wherein said hopper is open on the bottom and has four tabs, one tab in each of four comers of said hopper, for supporting the knockdown.

9. The apparatus of claim 8, wherein means are provided below said hopper for removing a lowermost knockdown from said hopper for transferring that lowermost knockdown to a box erector.

10. The apparatus of claim 1, wherein said hopper is open on the bottom and has at least two tabs, one on each of the opposite sides of said hopper, for supporting the knockdown.

11. The apparatus of claim 10, wherein means are provided below said hopper for pulling a lowermost knockdown downwardly past said tabs for removing that lowermost knockdown from said hopper for then separately transferring that lowermost knockdown to a box erector portion of the case printer-erector.

12. An apparatus for moving a knockdown oriented in a vertical position to a horizontal position, comprising:

a transfer mechanism having an upper knockdown kickout guide with an actuator and a lower knockdown kickout guide having a kicker, wherein said upper knockdown kickout guide being attached to a rod that is pivotally supported by the case printer-erector, and having an angle member including an upper portion and a bottom portion, said bottom portion defining a substantially right angle with an adjacent structure of said angle member and said upper portion aligned parallel to the vertically-oriented knockdown, and a plurality of fingers for contacting a surface of the knockdown and extending from a bottom edge of the angle member and disposed substantially parallel to said upper portion of said angle member, further wherein said actuator having a distal end attached to said upper knockdown kickout guide for causing pivoting of said upper knockdown kickout guide, still further wherein said lower knockdown kickout guide located below said upper knockdown kickout guide and having a driver with a distal end for causing reciprocation of said kicker connected to said distal end of said driver, and a hopper for receiving knockdowns from said transfer mechanism and retaining a plurality of knockdowns, said hopper being located adjacent to and at a lower level than said transfer mechanism and said hopper having two rollers adjacent to said transfer mechanism with horizontal axes oriented in parallel to a wall of said hopper adjacent to said transfer mechanism such that a top of each of said two rollers extends above said wall of said hopper, said hopper further being open on the bottom and having at least two tabs, one on each of opposite sides of said hopper, for supporting the plurality of knockdowns, wherein means are provided below said hopper for pulling a lowermost knockdown downwardly past said tabs for removing that lowermost knockdown from said hopper for then separately transferring that lowermost knockdown to a box erector portion of the case printer-erector.

13. A method for moving a knockdown oriented in a vertical position to a horizontal position in a hopper, comprising the steps of:

receiving a knockdown in a vertical position in a transfer mechanism having an angled upper and a horizontal lower knockdown kickout guides; contacting the surface of the knockdown at upper and lower positions according to said upper and lower kickout guides respectively;

pushing an upper portion of the knockdown outward from said transfer mechanism via said upper knockdown kickout guide;

pushing a lower portion of the knockdown outward from said transfer mechanism via said lower knockdown kickout in a substantially horizontal direction through a greater distance than and more quickly than said upper portion so as to angle the knockdown from its initially vertical position;

catching the upper edge of the knockdown with said angled upper knockdown kickout guide and the surface of said knockdown with fingers extending from said angled upper kickout guide;

pushing the knockdown upward and outward with said upper knockdown kickout guide at one or more points located closer to a bottom edge of the knockdown than said upper edge, such that the knockdown is impelled toward a hopper;

supporting the knockdown on one or more rollers at an edge of said hopper such that the knockdown moves toward said hopper on said one or more rollers; and receiving the knockdown into said hopper.

14. The method of claim 13, further comprising the step after receiving the knockdown into said hopper of retaining a plurality of knockdowns within said hopper.

* * * * *